US009247834B1

(12) United States Patent
Lucht et al.

(10) Patent No.: US 9,247,834 B1
(45) Date of Patent: Feb. 2, 2016

(54) SHELF LOCKING STRUCTURE FOR DISPLAY RACK

(71) Applicant: Midway Displays, Inc., Bedford Park, IL (US)

(72) Inventors: Wayne Lucht, Bedford Park, IL (US); Marco V. Prete, Bedford Park, IL (US)

(73) Assignee: Midway Displays, Inc., Bedford Park, IL (US)

( * ) Notice: Subject to any disclaimer, the term of this patent is extended or adjusted under 35 U.S.C. 154(b) by 0 days.

(21) Appl. No.: 14/503,857

(22) Filed: Oct. 1, 2014

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 5/13*** | (2006.01) |
| ***A47F 5/00*** | (2006.01) |

(52) U.S. Cl.
CPC ..... *A47F 5/13* (2013.01); *A47F 5/0018* (2013.01)

(58) Field of Classification Search
CPC ..... A47B 55/02; A47B 47/00; A47F 5/13; A47F 5/01
USPC ..... 211/186, 187
See application file for complete search history.

(56) References Cited

U.S. PATENT DOCUMENTS

| | | | | |
|---|---|---|---|---|
| 676,067 | A * | 6/1901 | Leonard | 108/109 |
| 2,869,731 | A | 1/1959 | Axelrod | |
| 2,982,424 | A * | 5/1961 | Van Syoc, Sr. | 108/187 |
| 3,172,376 | A * | 3/1965 | Havlis | 108/59 |
| 3,232,442 | A * | 2/1966 | Wilson | 211/133.2 |
| 3,252,434 | A * | 5/1966 | Young, Jr. | 108/181 |
| 3,316,864 | A * | 5/1967 | Maslow | 108/148 |
| 3,387,855 | A * | 6/1968 | Oliver | 280/79.3 |
| 3,435,958 | A * | 4/1969 | Chesley | 211/133.2 |
| 3,665,377 | A | 5/1972 | MacKenzie, Jr. | |
| 3,884,358 | A * | 5/1975 | Marschak | 211/186 |
| 3,977,529 | A * | 8/1976 | Stroh | 211/187 |
| 4,519,508 | A | 5/1985 | Gullett et al. | |
| 4,730,740 | A | 3/1988 | Winter et al. | |
| 4,858,773 | A * | 8/1989 | Zimmerman | 211/149 |
| 4,884,702 | A | 12/1989 | Rekow | |
| 5,718,441 | A * | 2/1998 | Kern et al. | 280/79.3 |
| 6,428,123 | B1 | 8/2002 | Lucht et al. | |
| 6,513,888 | B1 | 2/2003 | Lucht | |
| 6,659,294 | B1 * | 12/2003 | Simard | 211/181.1 |
| 7,128,494 | B2 | 10/2006 | Lucht | |
| 8,025,163 | B2 * | 9/2011 | McAllister et al. | 211/90.03 |
| 8,079,313 | B2 * | 12/2011 | Sparkowski | 108/110 |
| 8,196,761 | B2 * | 6/2012 | Morandi | 211/186 |
| 8,267,261 | B2 * | 9/2012 | Vanderhoek et al. | 211/150 |
| 2007/0199911 | A1 * | 8/2007 | Chen | 211/189 |
| 2010/0288717 | A1 * | 11/2010 | Morandi | 211/187 |

FOREIGN PATENT DOCUMENTS

DE 29701138 U1 * 3/1997

OTHER PUBLICATIONS

English Translation of DE 29701138 U1 pp. 1-5, retrieved from www.espce.net , Jun. 27, 2015.*

* cited by examiner

*Primary Examiner* — Joshua Rodden
*Assistant Examiner* — Kimberley S Wright
(74) *Attorney, Agent, or Firm* — Leydig, Voit & Mayer, Ltd.

(57) ABSTRACT

In a product display rack including a base frame, vertical upright corner support members, and optional header cross member, at least one locking shelf support bracket member is pivotally mountable to a pair of the vertical upright corner frame members and secures at least one shelf to the product display rack.

5 Claims, 7 Drawing Sheets

SHELF LOCKING STRUCTURE FOR DISPLAY RACK

FIELD OF THE INVENTION

This invention pertains generally to the field of product or merchandise display racks, and, in particular, to a shelf locking structure that facilitates the placement of a shelf and the adjustment of the location of a plurality of shelves without disassembly of the display rack.

BACKGROUND

Product or merchandise display racks are used for storing and displaying various types of goods or products in grocery stores, supermarkets, retail stores, or the like. A variety of product displays or merchandise displays are known. However, many product display racks use fixed shelves, where the shelves, once assembled, cannot be removed from the display or moved to a new location without disassembling and reassembling the entire product display rack. Others, while having adjustable shelves, do not have mechanisms for adequately securing the shelves to the frame resulting in shelves that can be easily or unintentionally removed, creating the risk of injury to either a customer who may accidentally bump the shelf or to an employee who is responsible for stocking or moving the product or merchandise display rack. Damage or destruction of products stored in the product display may also occur if the shelves are unintentionally displaced or removed from the shelf frame. This is disadvantageous, as shelves used for product displays need to be quickly and safely adjusted or removed so that the product display rack can be used and reused for storing and displaying different products of varying shape and size.

What is needed in an inexpensive, easy to use, and easy to assemble product display shelf which may be assembled without tools or small loose fastener parts and includes a shelf locking mechanism such that shelves can be easily installed and adjusted or removed without disassembly and reassembly of the entire display rack, but where the shelves are also securely affixed to the display rack frame to prevent unintentional displacement or removal of the shelves.

BRIEF SUMMARY OF THE INVENTION

According to embodiments of the present invention, a product display rack including a plurality of shelves for storing and displaying merchandise and a locking shelf support bracket for securing the plurality of shelves to the frame of the product display rack that can be assembled without tools or small fasteners is provided.

The locking shelf support bracket member is a generally U-shaped solid wire bracket member which includes a base having at least one member central catch and two hook legs which allow the locking shelf support bracket to be pivotally affixed to one side corner frame vertical supports of a product display rack. The catch member of the locking shelf support bracket is configured to allow a shelf mounted pivotally the other side corner frame supports to pivot past the catch member of the locking shelf support bracket so that the shelves are securely affixed to the product display rack.

It is a primary object of the present invention to provide an improved, simple, and low-cost product display rack that includes a shelf locking structure for securing adjustable shelves to the frame or the product display rack and the like without tools or small loose fasteners. In one of its important aspects, it is an object of the invention to provide a product display rack that includes adjustable shelves where the shelves can be moved on or removed from the frame of the product display rack without having to disassemble and reassemble the entire product display rack. Further objects and advantages of the present invention will become apparent from the detailed description in conjunction with the text below and attached drawings.

DETAILED DESCRIPTION OF THE INVENTION

Figure 1:
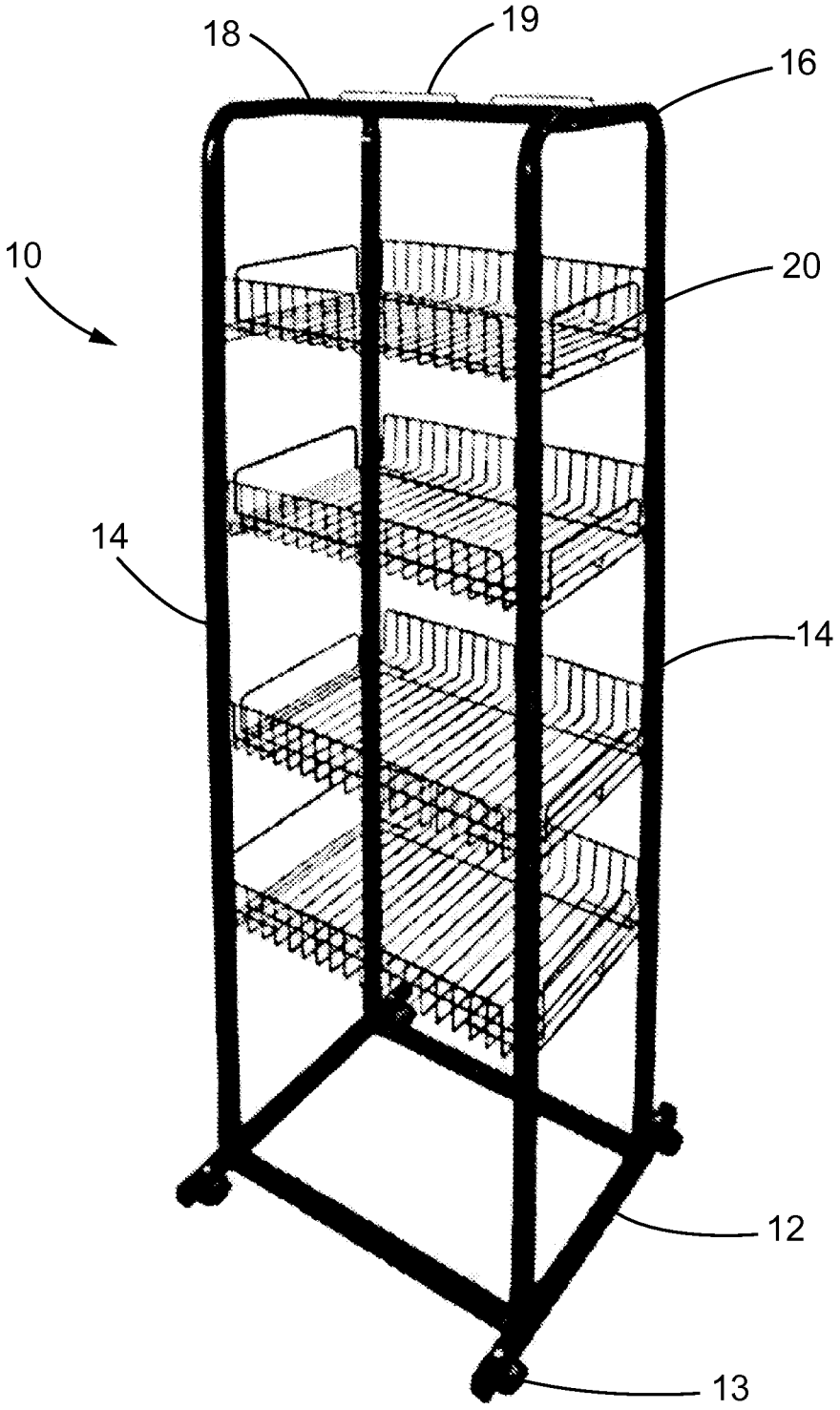
FIG. 1 is a front right perspective view of a product display rack according to an embodiment of the present invention.

For the purposes of promoting an understanding of the principles of the invention, reference will now be made to the embodiment in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1 through 7, conjointly, an exemplary product display rack generally indicated at 10 made up of a base frame 12, vertical upright corner frame members 14, and a header cross member 18, receives rack shelves 20 and locking shelf support bracket members 30. The display rack 10 includes a plurality of wire rack shelves 20 used to store and display, among other products, packaged food items.

The illustrative base frame 12 is formed as a single integral tubular frame that is generally rectangular in shape. In other embodiments, the base frame 12 may be generally rectangular in shape or generally square in shape. In one embodiment, the base frame 12 may include openings or holes on the upper and lower sides of the base frame. The openings or holes are aligned and sized to receive the pintle or stem of at least one caster 13.

The vertical upright corner frame members 14 are connected to the base support 12 and are configured to receive rack shelves 20 and locking shelf support bracket members 30. As best seen in FIG. 1, the vertical upright frame members 14 are mirror images of one another, and thus only one will be discussed in detail. The vertical upright frame member includes a top U-shaped member 16 and two straight legs 17 which extend downward from the U-shaped member. In some embodiments, the vertical upright frame member can be formed as a single integral piece. In other embodiments, the top U-shaped member and the straight legs 17 are formed as separate pieces and connected to form the vertical upright frame members 14. The end of the straight legs connect to the base support 12. In some embodiments, the base support 12 includes a plurality of short tubular posts or projections which extend upwardly from the base support 12 and form a connection with the straight legs of the vertical upright frame members 14.

The top U-shaped members 16 have openings in the inner face of the U-shaped member, which receive a header cross member 18. The header cross member 18 is a single tubular piece where each end of the header cross member 18 is inserted into the openings in the inner face of the top U-shaped members 16. In some embodiments, the header cross member and the vertical upright frame members can be manufactured as a single integral piece. In yet other embodiments, the header cross member can be welded to the top U-shaped members 16. At least one header wire 19 can be attached to the header cross member 18. The header wires 19 are configured to hold and display product advertisements.

The vertical upright frame members 14 each have a plurality of openings 15 in the inner face of the vertical upright frame member which are configured to receive the rack shelves 20 and the locking shelf support bracket members 30, each described in more detail below. The plurality of openings 15 extend down the straight legs 17 of each vertical upright frame member 14 and are spaced equidistant from one another. The openings in one vertical upright frame member 14 align with the openings in additional vertical upright frame members 14 such that the rack shelves 20 can be attached to both vertical upright frame members 14 at the same height.

Figure 2:
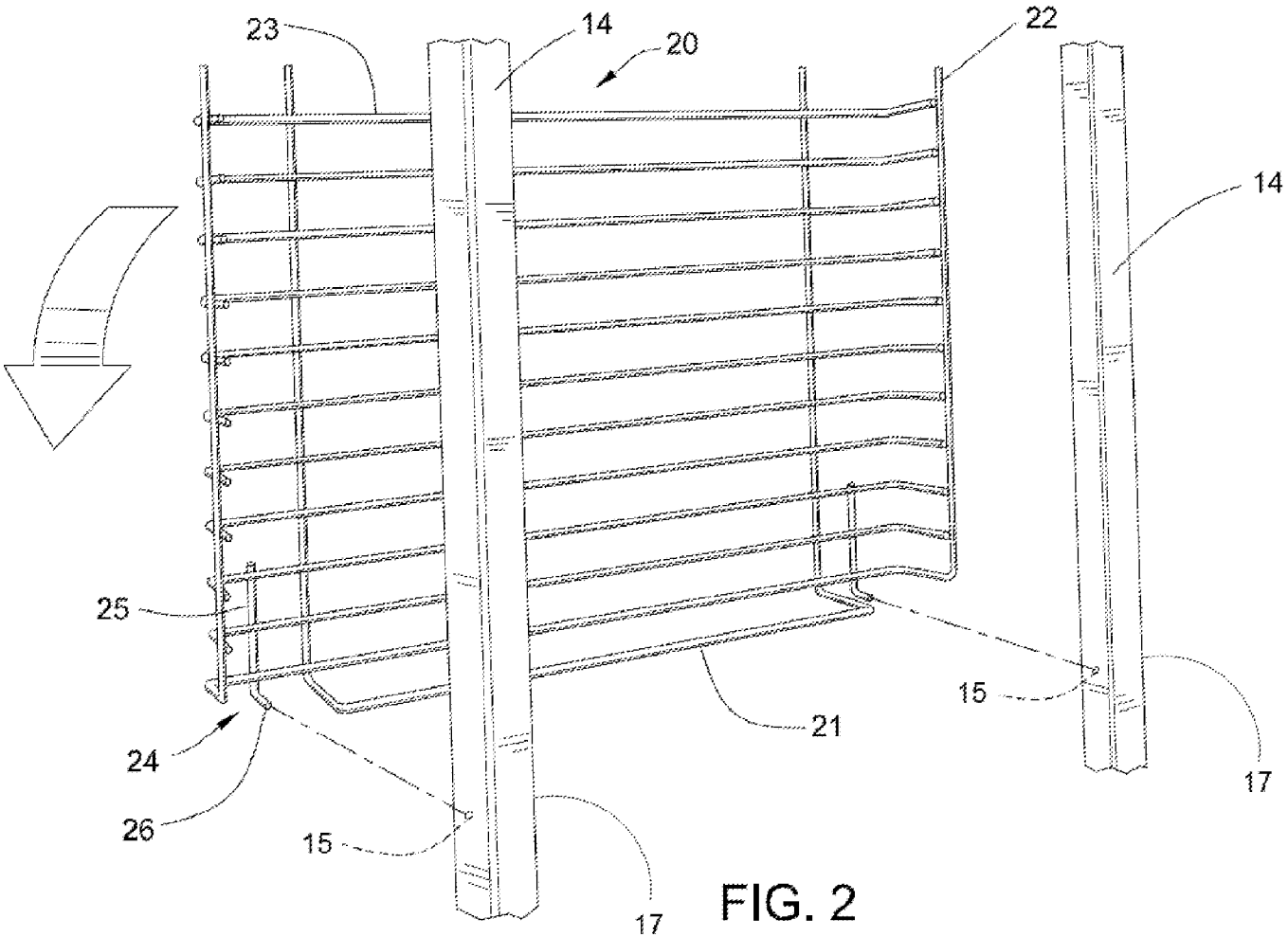
FIG. 2 is a partial enlarged and exploded view of one side portion of the display rack of FIG. 1, showing a partial wire rack shelf and a partial vertical upright frame member of the display rack.

The wire rack shelves 20 are used to store and display merchandise and are affixed to both vertical upright frame members 14. As best seen in FIGS. 1-2, the wire rack shelves 20 are generally rectangular in shape. In some embodiments, the wire rack shelves 20 can be square shaped. The product display rack 10 can accommodate at least one wire rack shelf 20. Additional wire rack shelves can be attached to the product display rack 10 if more storage space is desired. For example, FIG. 1 illustrates a product display rack 10 that accommodates four rack shelves.

In an embodiment, each wire rack shelf 20 is constructed of two cross perpendicular C-shaped frames, which form the end walls 21 and side walls 22. The side walls 22 are further supported by a series of U-shaped parallel wires 23 which are laid across the U-shaped end wall frame 21 and are welded to the U-shaped side wall frame 22. Each wire rack shelf 20 includes two parallel L-shaped wires 24 which are welded or otherwise affixed to the underside of the U-shaped frames. The L-shaped wire 24 includes a flat portion 25, which is welded or otherwise affixed to the underside of the U-shaped end wall and side wall frames, and a curved portion 26 which is configured to be pivotally inserted into one of the openings 15 in one of the vertical upright frame members 14.

Figure 5:
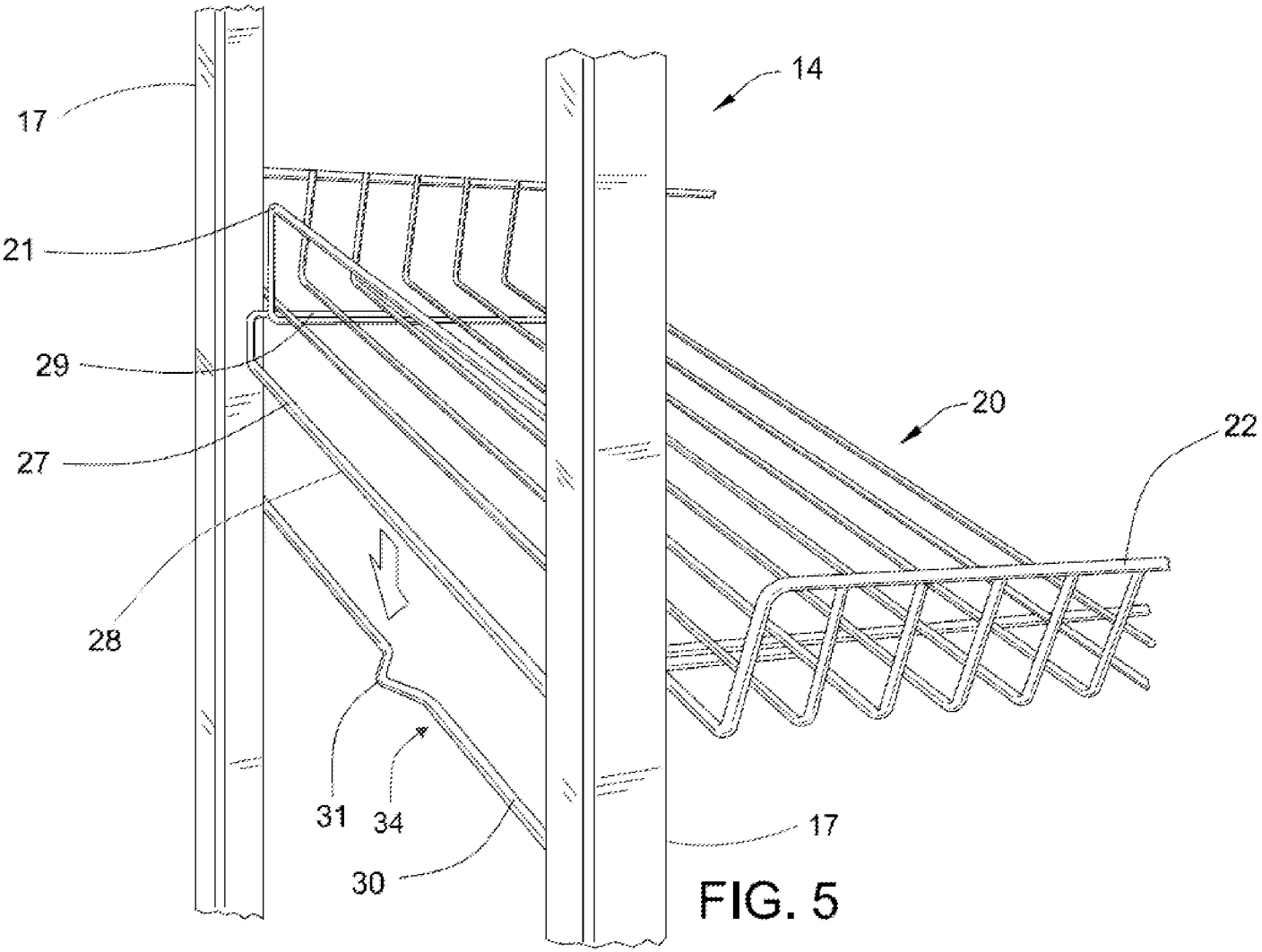
FIG. 5 is a partial enlarged view of the shelf locking side of the display rack of FIG. 1, showing the shelf locking member and a side of the shelf pivoting into place with the locking member bracket.
Figure 6:
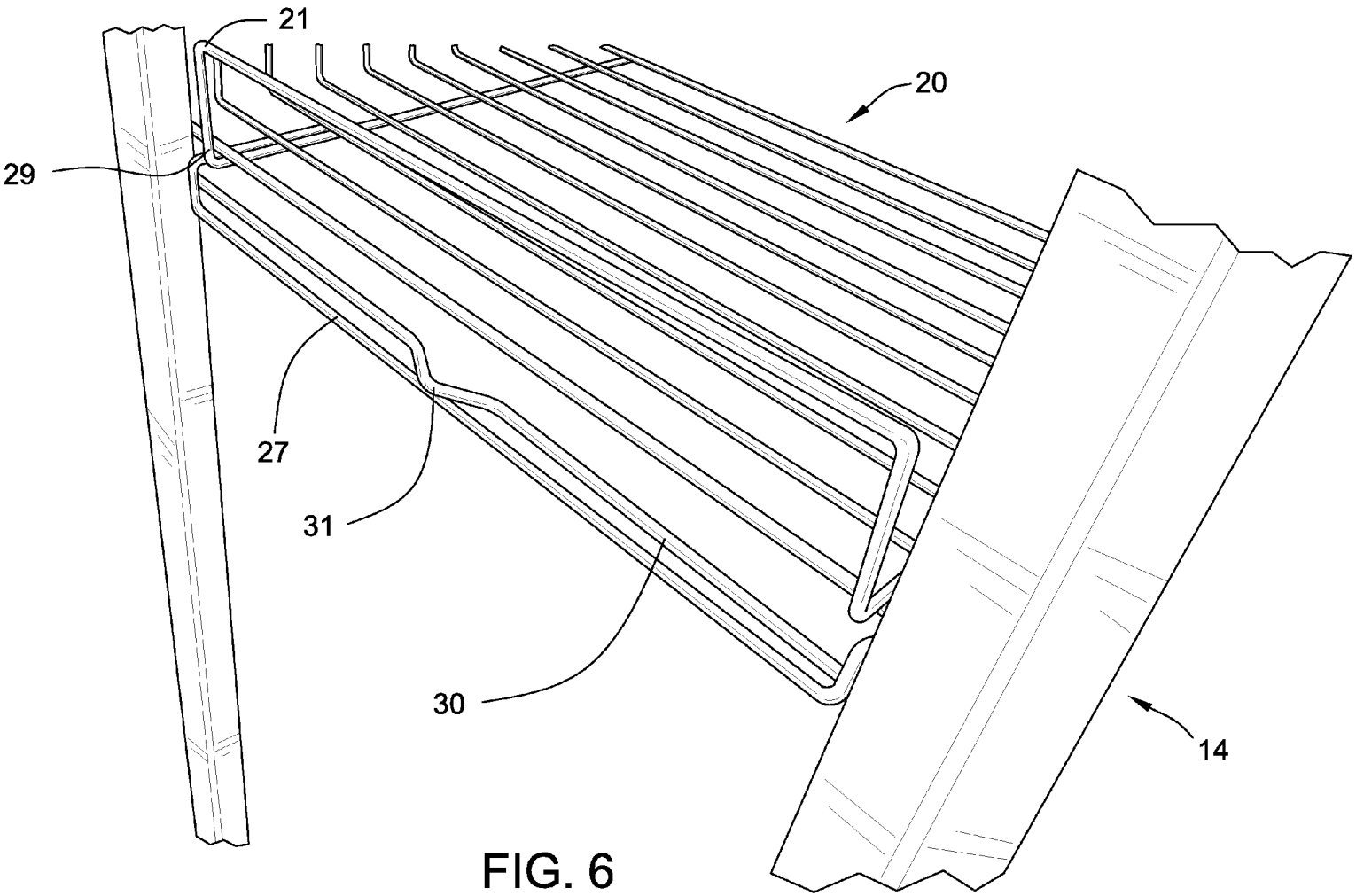
FIG. 6 is another enlarged view of the display rack of FIG. 1, showing the shelf locking bracket member interlocking with the shelf.
Figure 7:
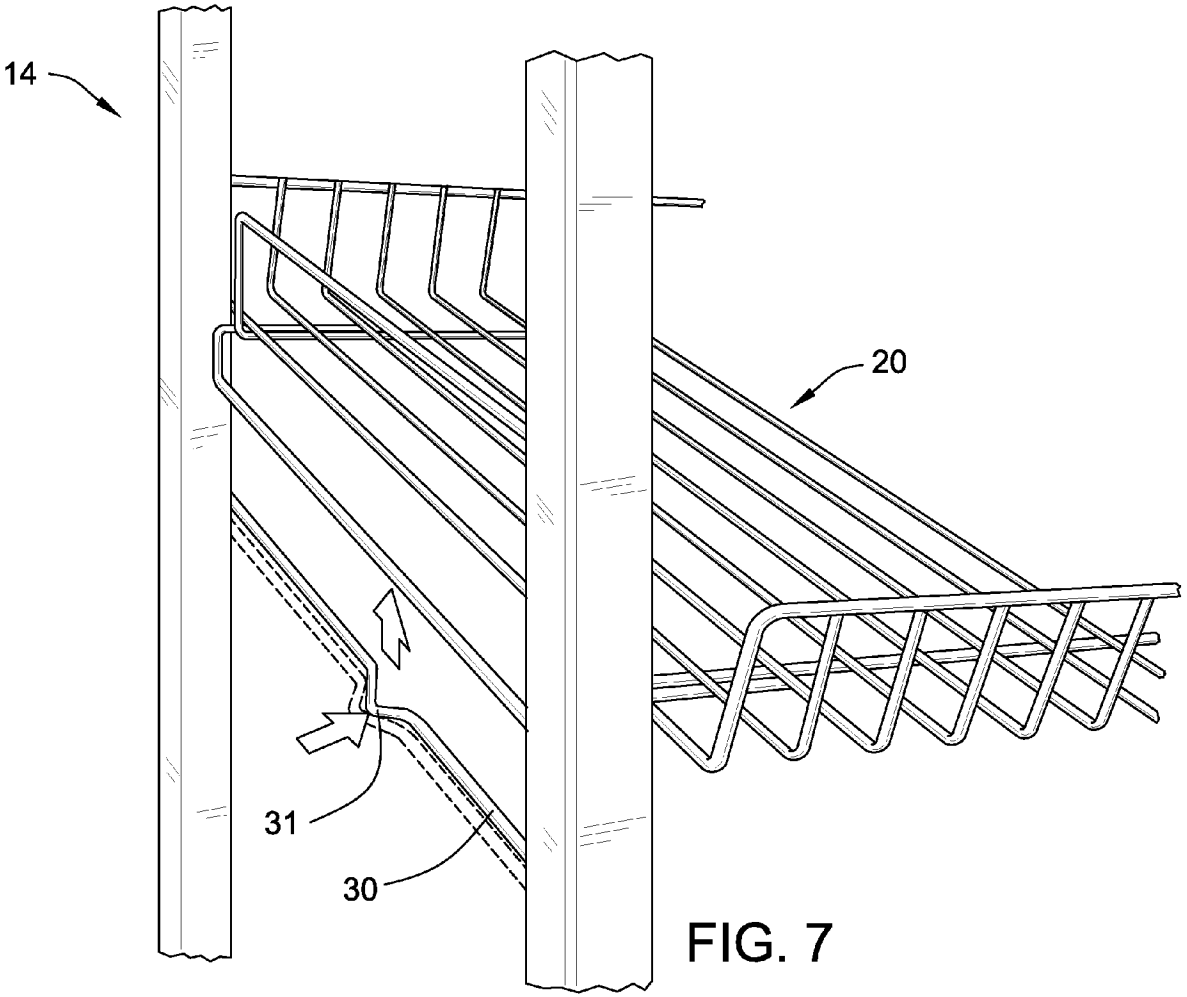
FIG. 7 is another enlarged partial end view of the shelf and locking bracket member of the display rack of FIG. 1, showing the shelf locking member pivotally moving to release the shelf and allowing the shelf to pivot upwardly.

As best seen in FIGS. 5-7, each wire rack shelf 20 also includes a U-shaped rack shelf attachment member 27 having a base 28 and legs 29. The rack shelf attachment member 27 is welded or otherwise affixed to the underside of the wire rack shelf 20. The placement of the rack shelf attachment member 27 is on the side of wire rack shelf 20 opposite the L-shaped wires 24. For example, if the L-shaped wires 24 are affixed on the right side of the wire rack shelf 20, then the rack shelf attachment member 27 will be affixed on the left side of the wire rack shelf 20. In some embodiments, the L-shaped wires 24 are positioned on the right side of the wire rack shelf 20 while the rack shelf attachment member 27 is positioned on the left side of the wire rack shelf 20. Thus, in other embodiments, the L-shaped wires 24 are positioned on the left side of the wire rack shelf 20 while the rack shelf attachment member 27 is positioned on the right side of the wire rack shelf 20. The base 28 of the rack shelf attachment member 27 extends downward from wire rack shelf 20, opposite the direction in which end walls 21 extend from the wire rack shelf 20. As described in more detail below, the base 28 of the rack shelf attachment member 27 is configured to be mounted onto the locking shelf support bracket member 30.

Figure 3:
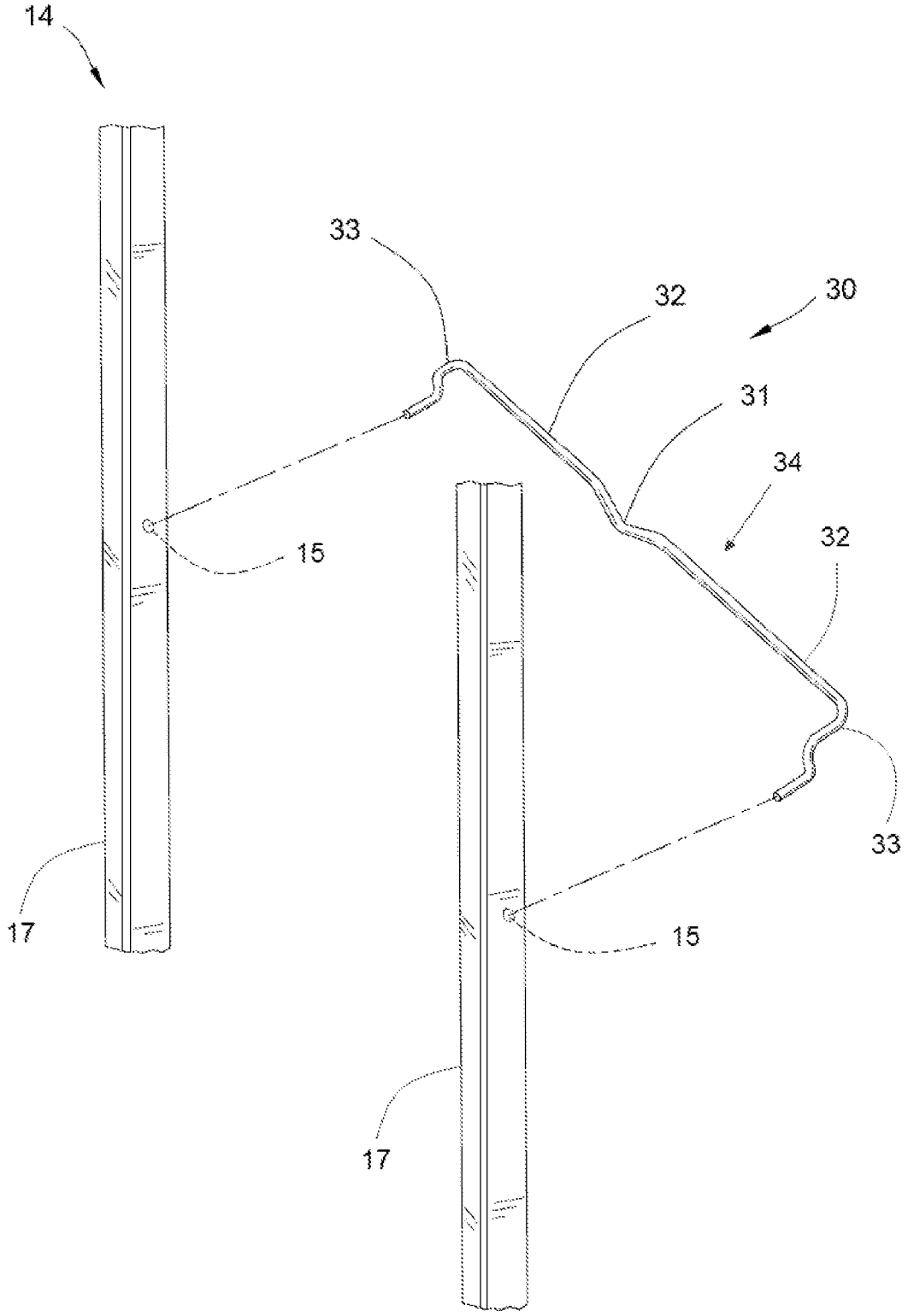
FIG. 3 is a partial exploded view of the vertical upright frame members and locking support bracket of the display rack of FIG. 1, showing attachment of the display rack upright support and the shelf locking bracket member.

In accordance with the present invention, as best seen in FIG. 3, a locking shelf support bracket member 30 is attached to the vertical upright frame members 14. The locking shelf support bracket member 30 is used to secure the wire rack shelves 20 to the product display rack 10. In the embodiment, the locking shelf support bracket member 30 is a generally U-shaped single wire piece including a base 34 forming a central catch member or hook 31 and two hook legs 32. Each hook leg 32 includes a compound bend 33. The compound bends 33 of the locking shelf support bracket member 30 can be inserted into the openings 15 in the vertical upright frame members 14. The compound bends 33 of the locking shelf support bracket member 30 allow the locking shelf support bracket 30 to be affixed to the vertical upright frame members 14 without the use of tools or other small fasteners. As shown in FIG. 5, the central catch member or hook 31 should be directed outwards, that is, away from an installed wire rack shelf 20, when the locking shelf support bracket member 30 is properly affixed to the vertical upright frame members 14.

Figure 4:
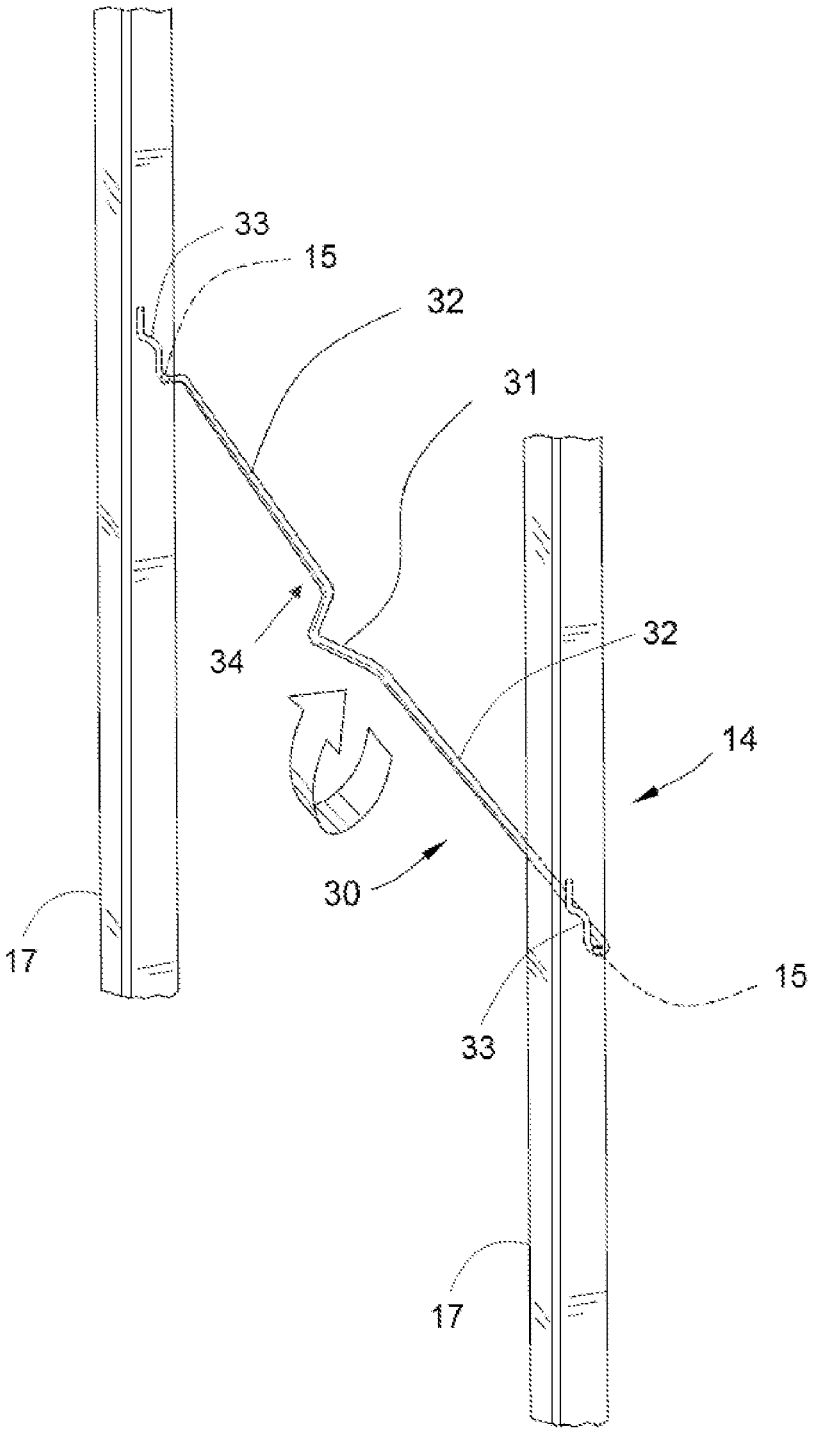
FIG. 4 is another enlarged view of a portion of the display rack of FIG. 1, showing the shelf locking bracket member inserted into a vertical upright frame member of the display rack being pivotally movable with respect to the side supports.

FIG. 3 and FIG. 4 illustrate the locking shelf support bracket member 30 affixed the vertical upright frame members 14. The compound bends 33 of the locking shelf support bracket member 30 are inserted into openings 15 in the vertical upright frame members 14 and then pivoted into place in order to lock into the vertical upright frame member. One important aspect of locking shelf support bracket member 30 is that the locking shelf support bracket member 30 can still be rotated when locked into place into the vertical upright frame members 14.

FIG. 5 illustrates the locking shelf support bracket member 30 locked into place on the vertical upright frame members 14. A portion of a rack shelf 20 is also illustrated. The rack shelf 20 including the rack shelf attachment member 27 is shown. The central catch member or hook 31 of the locking shelf support bracket member 30 and the rack shelf attachment member 27 form a connection in order to securely affix the rack shelf 20 to the product display rack 10.

FIG. 6 illustrates the rack shelf attachment member 27 of the shelf rack 20 being mounted onto the locking shelf support bracket member 30 to securely affix a shelf rack 20 to the product display rack 10. The rack shelf attachment member 27 in supported by the locking shelf support bracket member 30 and rests on the base 34 of the shelf support locking member. The central catch member or hook 31 prevents any upward motion of the rack shelf attachment member 27 with respect to the locking shelf support bracket member 30, such that the rack shelf 20 is securely affixed to the product display rack 10.

FIG. 7 illustrates the removal of the rack shelf 20 from the product display rack 10, which allows the rack shelves 20 to be removed from the product display rack 10, or to have the position of the rack shelf 20 adjusted if necessary. When securely affixed to the vertical upright frame members 14, the locking shelf support bracket member 30 can still be rotated via compound bends 33. In order to release the rack shelf attachment member 27 of the rack shelf 20 and allow the rack shelf 20 to be removed in order to be adjusted, the locking shelf support bracket member 30 is pivotally rotated along compound bends 33, moving the central catch hook 31 aside from the rack shelf attachment member 27. This allows the rack shelf attachment member 27 to be moved upwards and removed from the product display rack 10. Thus, the rack shelves 20 can be affixed and removed from the product display rack 10 without the use of tools or small fasteners and can instead be removed by pivotally rotating locking shelf support bracket member 30 with respect to vertical upright corner frame members 14 along compound bends 33. It will be appreciated that while the catch or hook member 31 is centrally located and V-shaped it can be provided in other shapes or numbers of catches positioned along the base 34.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A product display rack, comprising:

a first pair of vertical upright corner frame members and a second pair of vertical upright corner frame members disposed opposite the first pair so as to form four corners, each vertical upright corner frame member including at least one opening along an inner face of the vertical upright corner frame member;

at least one rack shelf;

at least one locking shelf support bracket member including a first compound bend at a first end of the at least one locking shelf support bracket member and a second compound bend at a second end of the at least one locking shelf support bracket member, the first compound bend passing through the at least one opening of a first vertical upright corner frame member of the first pair of vertical upright corner frame members and being received within the first vertical upright comet frame member, and the second compound bend passing through the at least one opening of a second vertical upright corner frame member of the first pair of vertical upright corner frame members and being received within the second vertical upright corner frame member, so as to pivotally affix the at least one locking shelf support bracket member to the first pair of vertical upright frame members; and a base portion that connects the first compound bend and the second compound bend, the base portion forming at least one V-shaped catch member;

wherein the at least one locking shelf support bracket member is configured to affix the at least one rack shelf to the first and second pairs of vertical upright corner frame members of the product display rack without the use of tools or fasteners;

wherein the openings of the first and second pairs of vertical upright corner frame members are configured to receive at least one of the at least one locking shelf support bracket member and the at least one rack shelf pivotally mounted thereon; and wherein the at least one rack shelf further includes a U-shaped rack shelf attachment member which is configured to affix the at least one rack shelf to the at least one locking shelf support bracket member.

2. The product display rack of claim 1, wherein the at least one rack shelf includes hook members configured to be received in the openings of the second pair of vertical upright corner frame members such that the at least one rack shelf is pivotally mounted thereon.

3. The product display rack of claim 1, wherein the U-shaped rack shelf attachment member comprises a base and two legs.

4. The product display rack of claim 1, wherein the at least one locking shelf support bracket member includes the base portion which forms the at least one V-shaped catch member.

5. The locking shelf support bracket member of claim 1, wherein the locking shelf support bracket member comprises a solid metal wire.

* * * * *